US005451707A

United States Patent [19]

Suzuki

[11] Patent Number: 5,451,707

[45] Date of Patent: Sep. 19, 1995

[54] FEED-BACK LOOP TYPE MUSICAL TONE SYNTHESIZING APPARATUS AND METHOD

[75] Inventor: Hideo Suzuki, Hamamatsu, Japan

[73] Assignee: Yamaha Corporation, Japan

[21] Appl. No.: 384,433

[22] Filed: Jan. 31, 1995

Related U.S. Application Data

[63] Continuation of Ser. No. 143,856, Oct. 26, 1993, abandoned.

[30] Foreign Application Priority Data

Oct. 28, 1992 [JP] Japan ..... 4-312944

[51] Int. Cl.[6] ..... G10H 1/12; G10H 7/02

[52] U.S. Cl. ..... 84/604; 84/622

[58] Field of Search ..... 84/602–607, 84/622, 623, 625, 659–661

[56] References Cited

U.S. PATENT DOCUMENTS

| | | | |
|---|---|---|---|
| 4,130,043 | 12/1978 | Niimi . | |
| 4,649,783 | 3/1987 | Strong et al. . | |
| 4,716,805 | 1/1988 | Deutsch | 84/604 |
| 5,131,310 | 7/1992 | Kumimoto | 84/604 |
| 5,136,912 | 8/1992 | Mokikawa | 84/603 |

*Primary Examiner*—Vit W. Miska
*Attorney, Agent, or Firm*—Graham & James

[57] ABSTRACT

In a loop circuit having a low-pass filter, a delay circuit, and an all-pass filter, a wave signal read from a wave memory is supplied as an excitation signal to the loop circuit and circulated therein to synthesize a musical tone signal. A musical tone signal to be synthesized and processed by a signal processing system having a characteristic inverse to the loop circuit is stored in the wave memory.

15 Claims, 3 Drawing Sheets

FEED-BACK LOOP TYPE MUSICAL TONE SYNTHESIZING APPARATUS AND METHOD

This is a continuation of application Ser. No. 08/143,856 filed on Oct. 26, 1993, now abandoned.

BACKGROUND OF THE INVENTION a) Field of the Invention

The present invention relates to a musical tone synthesizing apparatus and method, and more particularly to an apparatus and method for synthesizing a musical tone by a feedback loop system having a delay element and a filter.

b) Description of the Related Art

Recently, a sound source of an electronic musical instrument for synthesizing musical tones, called a physical model of a natural musical instrument, has been proposed in which the natural mechanism of generating sounds is replaced by an electronic circuit. The common characteristic feature of such physical models is to synthesize musical tones by exciting an oscillation in a loop circuit including a delay element and a filter, a delay caused by the delay element corresponding to the period of musical tones to be synthesized and an attenuation caused by the filter corresponding to the reflection loss of sound waves.

In such a physical model of a piano, for example, a Filter and a delay are connected in a loop to simulate a string of a piano. A strike on a string by a hammer is also replaced by an electronic circuit or signal. Namely, an excitation signal is injected to the loop to synthesize musical tones of the piano. In another physical model of a piano, a wave simulating an impact wave generated upon striking a string is stored in a wave memory. The wave is read from the memory to inject it into the loop and synthesize musical tones of the piano.

Conventional physical models has on one hand the advantage that during the rising and decay processes of oscillation, a power of expression similar to that of a natural musical instrument can be obtained and the manner of change in musical tones is natural, and has on the other hand the disadvantage that it is difficult to synthesize musical tones exactly the same as those generated by a natural musical instrument.

However, an absolute physical model cannot be formed practically. Physical phenomena can be replaced by electronic circuits only as approximate alternatives. Physical phenomena which have not been solved to date, are also present. If electronic circuits simulating every details of a physical phenomenon are designed without any approximation, this system becomes enormously large.

Even in the case where a wave simulating an impulse wave is stored and read, this physical model of a string is not complete. Selecting a suitable impulse wave has relied upon a trial and error basis.

SUMMARY OF THE INVENTION

It is an object of the present invention to provide an electronic system capable of synthesizing musical tones exactly the same as those natural musical tones which have been difficult to be synthesized by conventional physical models.

It is another object of the present invention to provide an electronic system capable of synthesizing musical tones exactly the same as natural musical tones while retaining the advantage of conventional physical models of a synthesizer system rich in expression during the rising and decay processes of oscillation, and also capable of editing musical tones to be synthesized and generating new musical tones different from original musical tones.

According to one aspect of the present invention, there is provided a musical tone synthesizer comprising: a signal feedback loop system having delay means and filter means for circulating an input signal and outputting a musical tone signal; analyzer means for receiving an external sound signal and outputting an analyzed result of the sound signal, the analyzer means having a characteristic inverse to the characteristic of the signal feedback loop system; and storage means for storing the analyzed result and supplying the analyzed result to the signal feedback loop system.

In the musical tone synthesizer having a loop circuit, a signal circulating the loop circuit is generated by an excitation signal, and an output signal from the loop circuit represents a musical tone waveform. There are definite cause and effect between the excitation signal and the generated musical tone signal.

By using the analyzer having a characteristic inverse to that of the loop circuit, it is possible to generate the excitation signal for the musical tone signal to be generated. Accordingly, the original musical tone waveform can be reproduced by using the excitation signal.

According to another aspect of the present invention, there is provided a musical tone synthesizing method in which a signal feedback loop system having delay means for delaying a signal and filter means for filtering the signal is oscillated upon reception of an excitation signal, the method comprising the steps of: analyzing the inverse characteristic of the signal feedback loop system; generating a musical tone signal to be synthesized later and processing the musical tone signal by a signal processing system having a characteristic corresponding to the analyzed inverse characteristic; and using the signal processed by the signal processing system as the excitation signal of the signal feedback loop system to synthesize the musical tone signal.

A musical tone signal to be synthesized later is generated and processed by the signal processing system having a characteristic inverse to that of the signal feedback loop system, and the processed signal is stored in a memory. Upon application of the processed signal to the signal feedback loop system as the excitation signal, the excitation signal is delayed, filtered, and fed back to circulate the loop and excite the oscillation in the loop.

According to another aspect of the present invention, there is provided a musical tone synthesizing method in which a signal feedback loop system with a variable characteristic having delay means for delaying a signal and filter means for filtering the signal is oscillated upon reception of an excitation signal, the method comprising the steps of: analyzing the inverse characteristic of the signal feedback loop system under a predetermined state; generating a musical tone signal to be synthesized later and processing the musical tone signal by a signal processing system having a characteristic corresponding to the analyzed inverse characteristic; using the signal processed by the signal processing system as the excitation signal of the signal feedback loop system to synthesize the musical tone signal; and changing the filtering characteristic of the filter means to change the characteristic of the musical tone signal to be synthesized.

A musical tone signal to be synthesized later is generated and processed by the signal processing system having a characteristic inverse to that of the signal feedback loop system with a variable characteristic under a predetermined state, and the processed signal is stored in a memory. Upon application of the processed signal to the signal feedback loop system in the same predetermined state, as the excitation signal, a musical tone signal same as the original musical tone signal is oscillated in the signal feedback loop system. By changing the characteristic of the signal feedback loop system, it is possible to edit musical tone signals to be synthesized and generate new musical tone signals different from original musical tones.

As described above, musical tone signals exactly the same as original musical tone signals can be synthesized by the feedback loop having a delay circuit and a filter.

In addition, it is possible to edit and synthesize new musical tone signals different from original musical tones.

BRIEF DESCRIPTION OF THE DRAWINGS

The above and other objects, features and advantages of the invention will become apparent from the following detailed description of the preferred embodiments when read in conjunction with the accompanying drawings, wherein.

DETAILED DESCRIPTION OF THE PREFERRED EMBODIMENTS

Figure 1A:
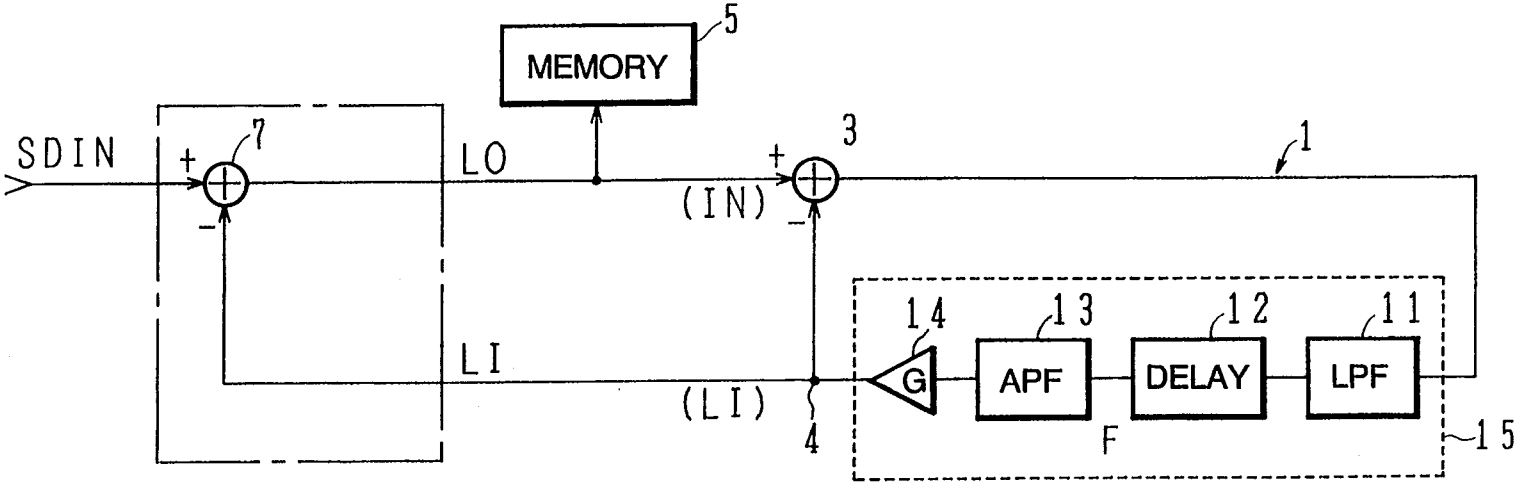
FIGS. 1A and 1B are circuit diagrams explaining the principle of the operation of a sound source according to the invention.
Figure 1B:
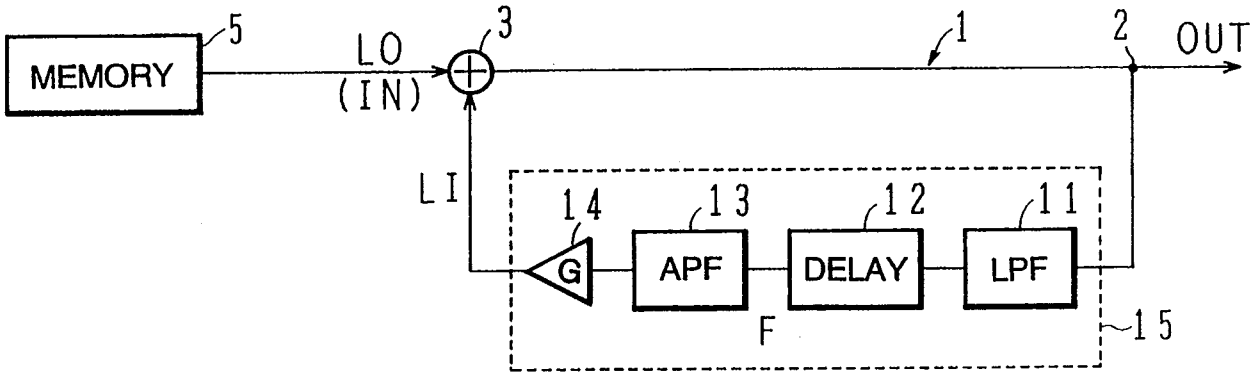

FIGS. 1A and 1B show the main part; of an embodiment of a sound source of an electronic musical instrument according to the present invention. FIG. 1A is a circuit diagram of a sound analyzer of the sound source, and FIG. 1B is a circuit diagram of a sound synthesizer of the sound source.

Referring to FIG. 1A, the analyzer includes a loop circuit 1 made of an adder 3 and a function circuit 15. The function circuit 15 has a low-pass filter 11, a delay circuit 12, an all-pass filter 13, and a gain controller 14. The function circuit 15 has an impulse response F.

An input signal SDIN is applied to a subtracter 7 whose output LO is supplied to one input terminal of the adder 3 and also stored in a memory 5. An output signal LI from the function circuit 15 at a node 4 is fed back to the adder 8 and to the minus input terminal of the subtracter 7.

The function of this analyzer will be described. The output signal LO of the subtracter 7 is expressed by $$LO=SDIN-LI \tag{1}$$

This difference signal LO is stored in the memory 5, and also supplied to one input terminal of the adder 3 which is the signal input terminal to the loop circuit 1. The adder 3 adds the input signal LO to the output signal LI of the function circuit 15, the added signal being supplied as an input signal to the function circuit 15. This sum signal (LI+LO) is transformed to a signal F (LI+LO) after passing through the function circuit 15 having the impulse response F. The signal F (LI+LO) is the output signal LI of the function circuit 15. This yields, therefore $$LI=F(LI+LO) \tag{2}$$

i.e., $$LI=[F/(1-F)\pi\ LO$$

from the equations (1) and (2), $$SDIN-LI=SDIN-[F/(1-F)\ LO=LO \tag{3}$$

The equation (3) is rewritten as $$SDIN=[1+F/(1-F)]LO=LO/(1-F) \tag{4}$$

The synthesizer shown in FIG. 1B has the same loop circuit 1 and memory 5 as those of the analyzer shown in FIG. 1A. The signal LO stored in the memory 5 of the analyzer is read by the synthesizer. Assuming that the output of the function circuit 15 is LI like the analyzer shown in FIG. 1A, the output signal from the adder 8 becomes (LO+LI) which is outputted as an output signal OUT from a node 2. Namely $$\mathrm{OUT}=LO+LI \tag{5}$$

The signal is an output of the function circuit 15 when the signal OUT is supplied thereto. Therefore, $$\mathrm{LI}=\mathrm{F}^*\mathrm{OUT} \tag{6}$$

From the equations (5) and (6), $$LO+\mathrm{OUT}^*F=\mathrm{OUT}$$

$$\mathrm{OUT}=LO/(1-F) \tag{7}$$

The output signal OUT is therefore equal to the input signal SDIN of the analyzer shown in FIG. 1A.

In the analyzer shown in FIG. 1A, the circuit portion having an input terminal for the signal SDIN and an output terminal connected to the memory 5 has the characteristic given by the equation (4)

$$LO=SDIN(1-F)$$

Namely, this circuit portion has an inverse characteristic to that of the analyzer which is $$\mathrm{OUT}=LO/(1-F)$$

As seen from FIGS. 1A and 1B, the synthesizer can be formed by part of the analyzer.

By using a sound source having the analyzer and synthesizer shown in FIGS. 1A and 1B, an original sound can be reproduced if the analyzed result of the original sound is once stored in the memory, by reading the analyzed result and generating a corresponding musical tone signal.

In the foregoing description, it is assumed that parameters of the function circuit 15 have definite values, the parameters including the cut-off frequency of the low-pass filter 11, the delay time of the delay circuit 12, the phase shift of the all-pass filter 13, and the gain of the gain adjuster 14. If the parameters of the function circuit 15 are changed between the analyzing and synthesizing operations, a musical tone signal having a different tone color or property from the inputted and sampled sound can be generated.

Figure 2:
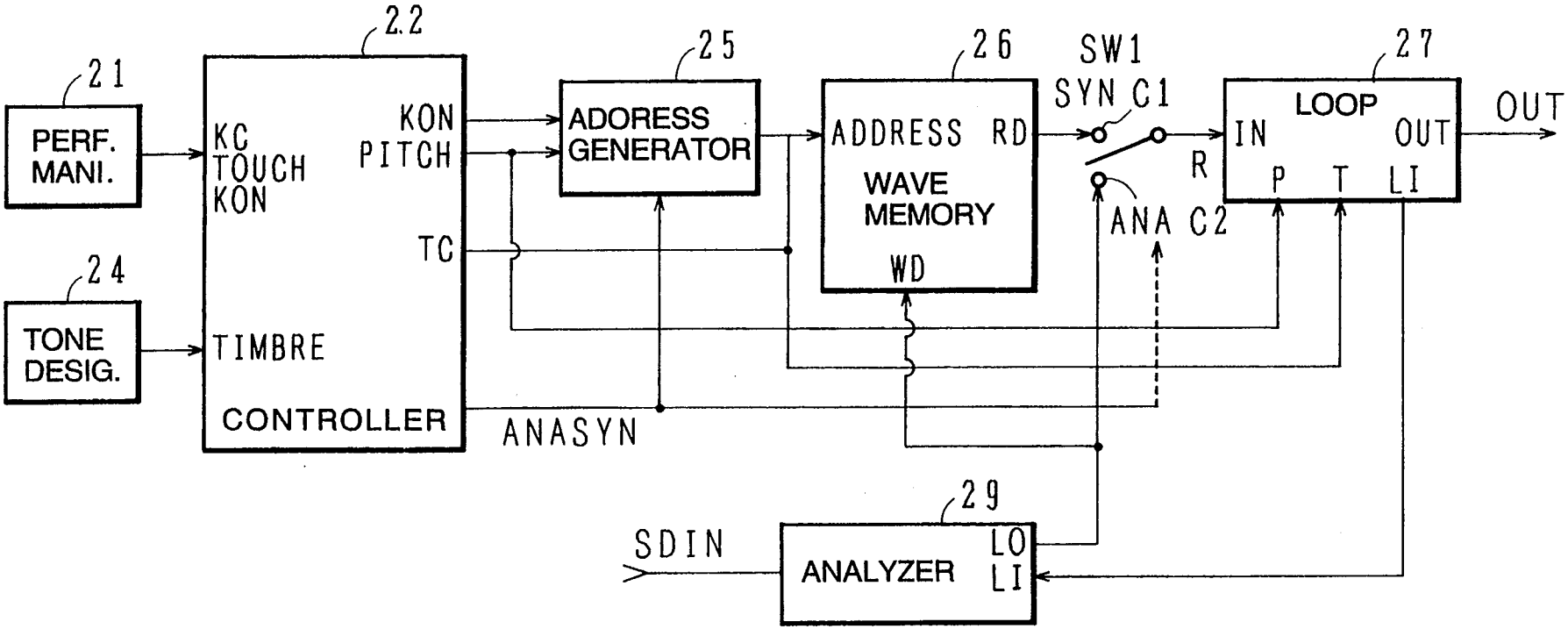
FIG. 2 is a circuit diagram of the sound source according to an embodiment of the present invention.

FIG. 2 is a circuit diagram of a sound source having the analyzer and synthesizer such as shown in FIGS. 1A and 1B.

Referring to FIG. 2, a performance manipulator 21 such as a keyboard and a tone designator 24 such as tone color switches supply their output signals to a controller 22. For example, the performance manipulator 21 generates signals such as a key code signal KC, a touch signal TOUCH, and a key-on signal KON. The tone designator 24 generates signals such as a timbre signal TIMBRE corresponding to the tone color designated by a user by depressing a corresponding switch.

The controller 22 supplies signals such as the key-on signal KON and a pitch signal PITCH generated from the key code signal KC, to an address generator 25 which then generates an address for a wave memory 26. The pitch signal PITCH is also supplied to a P terminal of a loop circuit 27.

The controller 22 also generates a tone color signal TC from the timbre signal TIMBRE and the like, and supplies it to the wave memory 26 and loop circuit 27. The wave memory 26 has a read terminal RD and a write terminal WD. The read terminal RD is connected to a synthesizer contact C1 of a switch SW1. A movable contact R of the switch SW1 is connected to an input terminal IN of the loop circuit 27.

The controller 22 also generates a select signal ANASYN for selecting either an analyzing operation or a synthesizing operation, and supplies it to the address generator 25 and to the switch SW1 to control its movable contact R. Namely, the movable contact R is connected to an analyzer contact C2 when analyzing, and to the synthesizer contact C1 when synthesizing.

The sound source also has an analyzer 29 to which a sound input signal SDIN is applied. The analyzer 29 applies its output signal LO to the write terminal WD of the memory 26 and to the analyzer contact C2 of the switch SW1. The loop circuit has an LI signal terminal LI to feed back the LI signal to the analyzer 29.

For the analyzing operation, the movable contact R of the switch SW1 is connected to the analyzer contact C2. The output terminal LO of the analyzer 29 connected to the write terminal WD of the wave memory 26, is therefore connected to the input terminal IN of the loop circuit 27 via the switch SW1. Since the LI signal terminal LI of the loop circuit 27 is being connected to the LI terminal of the analyzer 29, the analyzer such as shown in FIG. 1A can be established during the analyzing operation.

For the synthesizing operation, the movable contact R of the switch SW1 is connected to the synthesizer contact C1. In this state, the read terminal RD of the wave memory 26 is connected to the input terminal IN of the loop circuit 27, and the output signal OUT is delivered from the output terminal OUT of the loop circuit 27. Namely, the analyzer such as shown in FIG. 1B can be established during the synthesizing operation.

Figure 3A:
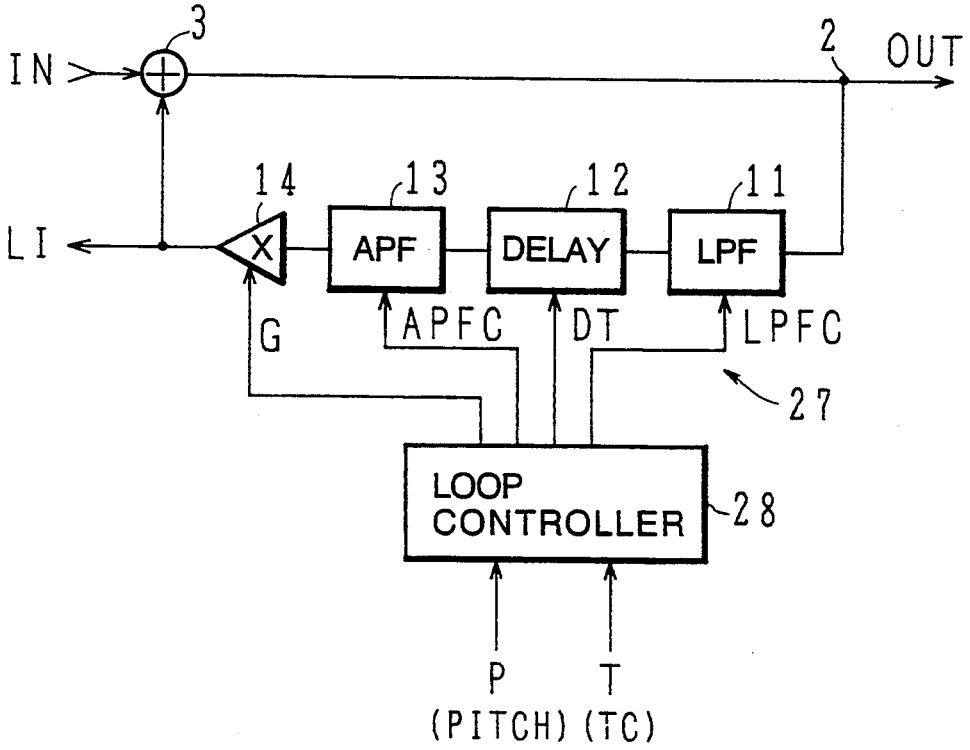
FIGS. 3A and 3B are a circuit diagram of the loop circuit and a graph showing the output level of the sound source relative to the frequency according to the embodiment of the invention.

The structure of the loop circuit 27 is shown in FIG. 3A. The loop circuit 27 has the same structure as that of the loop circuit 1 shown in FIGS. 1A and 1B, and further includes a loop controller 28. The loop controller 28 receives a pitch signal P and a tone color signal T, and generates and supplies a coefficient LPFC to the low-pass filter 11 for the control of a cut-of frequency, a coefficient DT to the delay circuit 12 for the control of a delay time, a coefficient APFC to the all-pass filter 13 for the control of a phase change amount, and a coefficient G to the gain adjuster 14 for the control of a gain. In other words, the characteristic of the loop circuit 27 changes with the pitch P and tone color T.

For-the analyzing operation, the characteristic of the loop circuit 27 is set to a predetermined state by the loop controller 28. Namely, the coefficients LPFC, DT, APFC, and G are set to predetermined values. By using the same coefficient values as those during the analyzing operation, musical tones analyzed can be synthesized and reproduced at a high fidelity. If different coefficient values are used, musical tones different from original musical tones can be synthesized. The amount of analyzed data becomes less in most cases if the delay time of the delay circuit 12 is set to the period of musical tones. On the other hand, the tone color change by different coefficients becomes greater if the delay is set differently from the period. Accordingly, it is preferable to change the coefficient values in accordance with the characteristics of sounds to be reproduced.

Figure 3B:
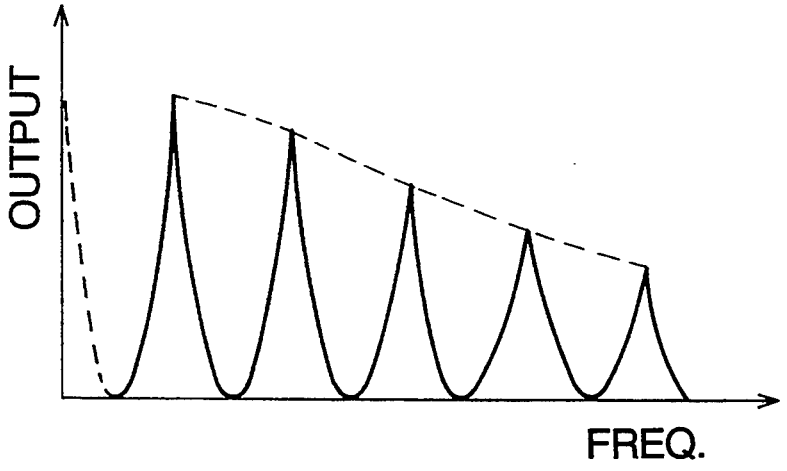

FIG. 3B is a graph showing the characteristic of the loop circuit shown in FIG. 3A. The abscissa represents a frequency, and the ordinate represents an output level. As shown in FIG. 3B, the characteristic of the loop circuit 27 shows peaks at equal frequency intervals corresponding to the total delay time off the loop circuit 27. The tendency of reducing the output levels of peaks as the frequency becomes high, is governed by the characteristic of the low-pass filter 11 or the like of the loop circuit 27. The interval of peaks is governed by the delay time of the delay circuit 12 or the like of the loop circuit 27. The characteristic of the all-pass filter 13 changes the positions of peaks delicately.

By using the sound source shown in FIGS. 2, 3A, and 3B, such an original sound as musical sounds of a natural musical instrument can be reproduced at a high fidelity by reading the sampled and analyzed result of the original sound from the memory to synthesize the original sound. If the characteristic of the loop circuit is made different between the analyzing and synthesizing operations, the tone color of a reproduced sound can be changed.

For example, If sounds not present in the natural world are to be synthesized, such sounds can be generated by studying the analyzed results of a variety of sounds and changing the characteristic of the loop circuit.

The analyzer may be structured so that an analyzed result of sounds can be outputted as FM-modulated and sounds different from original sounds can be synthesized. Various types of modulation can be used to widen the sound generation range of a synthesizer system. This embodiment may be realized by using a digital signal processor (DSP) with hardware of filter and the like. The circuit elements may also be implemented by soft ware in a computer.

The present invention has been described in connection with the above embodiments shown in the drawings. The invention is not intended to be limited only to the embodiments. For example, a plurality of filters may be used and connected in different ways such as serial and parallel connections to selectively use them for the analyzing and synthesizing operations. The invention is also applicable to a physical model including non-linear conversion devices. It is apparent for those skilled in the art that various other alterations, modifications, improvements, and combinations are possible within the sprit and scope of the invention.

I claim:

1. A musical tone synthesizer comprising:

a signal feedback loop system having delay means and filter means for circulating an input signal and outputting a musical tone signal;

analyzer means for receiving an external sound signal and outputting an analyzed result of said sound signal, said analyzer means having a characteristic inverse to the characteristic of said signal feedback loop system; and storage means for storing said analyzed result and supplying said analyzed result to said signal feedback loop system.

2. A musical tone signal synthesizer according to claim 1, wherein:

said feedback loop system includes a function circuit having a response function F and an adder, said function circuit and said adder being connected in a loop, and said analyzer means includes a subtracter having a minus terminal for receiving an output of said function circuit and a plus terminal for receiving an input signal, and means for supplying an output of said subtracter to said adder of said feedback loop system.

3. A musical tone signal synthesizer according to claim 2, further comprising a control circuit for controlling circuit coefficients of said function circuit.

4. A musical tone signal synthesizer according to claim 2, further comprising a performance unit for inputting pitch information and touch information and controlling the read operation of said storage means.

5. An electronic musical instrument comprising:

performance means for generating musical tone information including at least pitch and touch information;

means for generating a signal for selecting either a musical tone analyzing operation or a musical tone synthesizing operation;

a wave memory for storing various waveforms, said wave memory having an address input terminal, a data input terminal, and a data output terminal;

control means for controlling the read/write operation of said wave memory by supplying an address signal to said address input terminal of said wave memory in accordance with said musical tone information from said performance means;

a loop circuit including a function circuit, an adder and an output terminal, connected in a loop, said adder functioning as an input port of said loop circuit;

a subtracter having a plus terminal, a minus terminal, and an output terminal;

means for connecting the output terminal of said loop circuit to the minus terminal of said subtracter;

means for connecting the output terminal of said subtracter to the data input terminal of said wave memory; and switch means for selectively connecting one of the output terminal of said subtracter and the data output terminal of said wave memory to said adder of said loop circuit.

6. A musical tone synthesizing method in which a signal feedback loop system having delay means for delaying a signal and filter means for filtering said signal is oscillated upon reception of an excitation signal, said method comprising the steps of:

analyzing the inverse characteristic of said signal feedback loop system;

generating a musical tone signal to be synthesized and processing said musical tone signal by a signal processing system having a characteristic corresponding to said analyzed inverse characteristic; and using said signal processed by said signal processing system as said excitation signal of said signal feedback loop system to synthesize said musical tone signal.

7. A method according to claim 6, wherein the characteristic of said feedback loop system is changed between a synthesizing operation and an analyzing operation.

8. A musical tone synthesizing method in which a signal feedback loop system with a variable characteristic having delay means for delaying a signal and filter means for filtering said signal is oscillated upon reception of an excitation signal, said method comprising the steps of:

analyzing the inverse characteristic of said signal feedback loop system under a predetermined state;

generating a musical tone signal to be synthesized and processing said musical tone signal by a signal processing system having a characteristic corresponding to said analyzed inverse characteristic;

using said signal processed by said signal processing system as said excitation signal of said signal feedback loop system to synthesize said musical tone signal; and changing the filtering characteristic of said filter means to change the characteristic of said musical tone signal to be synthesized.

9. A musical tone synthesizer comprising:

a signal feedback loop system having delay means for circulating an input signal and outputting a musical tone signal; analyzer means, having a characteristic inverse to the characteristic of said signal feedback loop system, responsive to a musical tone input signal for generating an excitation signal; and supply means for supplying the excitation signal to said signal feedback loop system.

10. A musical tone signal synthesizer according to claim 9, wherein said supply means includes a wave memory which stores a wave shape of said excitation signal.

11. A musical tone signal synthesizer according to claim 9, wherein said feedback loop system includes filter means for filtering the circulating input signal.

12. A musical tone signal synthesizer according to claim 9, wherein said feedback loop system includes a function circuit having a response function F and an adder, said function circuit and said adder being connected in the loop.

13. A musical tone signal synthesizer according to claim 12, further comprising a control circuit for controlling circuit coefficients of said function circuit.

14. A musical tone signal synthesizer according to claim 12, further comprising a performance unit for inputting pitch information and touch information to said control circuit;

wherein said control circuit controls circuit coefficients of said function circuit in accordance with the pitch information and the touch information input from said performance unit.

15. A musical tone synthesizing method using a signal feedback loop system including delay means for delaying a signal and filter means for filtering said signal connected in a loop, comprising the steps of:

inputting a musical tone signal to analyzer means having a characteristic inverse to the characteristic of said signal feedback loop system for generating an excitation and signal supplying the excitation signal to said signal feedback loop system to allow the excitation signal to circulate in the loop, thereby synthesizing a musical tone signal.

* * * * *